US009695825B2

(12) United States Patent
Hikichi et al.

(10) Patent No.: US 9,695,825 B2
(45) Date of Patent: Jul. 4, 2017

(54) ROTARY COMPRESSOR

(71) Applicant: Panasonic Corporation, Kadoma-shi, Osaka (JP)

(72) Inventors: Takumi Hikichi, Osaka (JP); Kentaro Shii, Osaka (JP); Masanobu Wada, Saitama (JP); Tadayoshi Shoyama, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 173 days.

(21) Appl. No.: 14/342,693

(22) PCT Filed: Jul. 2, 2013

(86) PCT No.: PCT/JP2013/004107

§ 371 (c)(1),
(2) Date: Mar. 4, 2014

(87) PCT Pub. No.: WO2014/010199

PCT Pub. Date: Jan. 16, 2014

(65) Prior Publication Data

US 2014/0219851 A1 Aug. 7, 2014

(30) Foreign Application Priority Data

Jul. 9, 2012 (JP) ..... 2012-153808

(51) Int. Cl.

| | |
|---|---|
| ***F04C 23/00*** | (2006.01) |
| ***F01C 1/063*** | (2006.01) |
| ***F03C 2/22*** | (2006.01) |
| ***F16N 13/20*** | (2006.01) |
| ***F04C 18/344*** | (2006.01) |
| ***F01C 21/04*** | (2006.01) |

(Continued)

(52) U.S. Cl.
CPC ..... *F04C 29/028* (2013.01); *F04C 18/3562* (2013.01); *F04C 18/3564* (2013.01);
(Continued)

(58) Field of Classification Search
CPC F04C 18/3562; F04C 18/3564; F04C 23/008; F04C 29/028; F04C 29/04; F04C 2240/809
(Continued)

(56) References Cited

U.S. PATENT DOCUMENTS 7,377,755 B2 * 5/2008 Cho ..... F01C 21/0863 417/310
2010/0089092 A1 4/2010 Hasegawa et al.
(Continued)

FOREIGN PATENT DOCUMENTS

CN 101680300 3/2010
CN 101688537 3/2010
(Continued)

OTHER PUBLICATIONS

Extended European Search Report issued in corresponding European Application No. 13817101.2, Jun. 24, 2015, 4 pages.
(Continued)

*Primary Examiner* — Deming Wan
(74) *Attorney, Agent, or Firm* — Hamre, Schumann, Mueller & Larson, P.C.

(57) ABSTRACT

A rotary compressor (100A) includes a closed casing (1), a compression mechanism (48), a lower end-face plate (34), and a communication hole (50). An oil reservoir (12) is formed at the bottom of the closed casing (1). The lower end-face plate (34) divides the oil reservoir (12) into a plurality of sections (12*a*) and (12*b*) in the vertical direction. The plurality of sections of the oil reservoir (12) communicate with each other through the communication hole (50). The communication hole (50) is located on the same side as a discharge port (8*b*) of the compression mechanism (48) with respect to a reference plane (H1).

10 Claims, 7 Drawing Sheets

(51) Int. Cl.

| | |
|---|---|
| ***F04C 15/00*** | (2006.01) |
| ***F04C 29/02*** | (2006.01) |
| ***F04C 29/04*** | (2006.01) |
| ***F04C 18/356*** | (2006.01) |

(52) U.S. Cl.
CPC ..... *F04C 23/008* (2013.01); *F04C 29/04* (2013.01); *F04C 23/001* (2013.01); *F04C 2240/30* (2013.01); *F04C 2240/809* (2013.01)

(58) Field of Classification Search
USPC ..... 418/11, 60, 63, 94, 270
See application file for complete search history.

(56) References Cited

U.S. PATENT DOCUMENTS

| | | | | |
|---|---|---|---|---|
| 2010/0215524 | A1* | 8/2010 | Ogasawara | F04C 29/026 417/410.3 |
| 2010/0275638 | A1 | 11/2010 | Hasegawa et al. | |
| 2012/0039735 | A1 | 2/2012 | Lee | |

FOREIGN PATENT DOCUMENTS

| | | | |
|---|---|---|---|
| CN | 102374165 | | 3/2012 |
| EP | 2 034 131 | | 3/2009 |
| JP | 60-134882 | U | 9/1985 |
| JP | 60-173388 | | 9/1985 |
| JP | 61-204989 | U | 12/1986 |
| JP | 62-137393 | U | 8/1987 |
| JP | 2-140486 | | 5/1990 |
| JP | 2002-221180 | | 8/2002 |
| JP | 2004-251129 | | 9/2004 |
| WO | 2012/090345 | | 7/2012 |

OTHER PUBLICATIONS

Office Action issued in corresponding Chinese Patent Application No. 201380002951.6, Dec. 30, 2015, 4 pages with translation.

* cited by examiner

ROTARY COMPRESSOR

TECHNICAL FIELD

The present invention relates to rotary compressors.

BACKGROUND ART

Rotary compressors are widely used in electrical appliances such as air conditioners, heaters, and hot water dispensers. As one approach to improve the efficiency of rotary compressors, there has been proposed a technique for suppressing a so-called heat loss, i.e., a decrease in efficiency caused by the fact that a refrigerant drawn into a compression chamber (a drawn refrigerant) receives heat from the environment.

A rotary compressor of Patent Literature 1 has a closed space provided in the suction-side portion of a cylinder as means for suppressing heat reception by a drawn refrigerant. The closed space suppresses heat transfer from the high-temperature refrigerant in the closed casing to the inner wall of the cylinder.

CITATION LIST

Patent Literature

Patent Literature 1: JP 2-140486 A

SUMMARY OF INVENTION

Technical Problem

However, it is not necessarily easy to form a closed space in a cylinder as in Patent Literature 1. Therefore, another technique capable of effectively suppressing heat reception by a drawn refrigerant has been desired.

Solution to Problem

That is, the present disclosure provides a rotary compressor including:

a closed casing including an oil reservoir;

a compression mechanism including: a cylinder; a piston disposed inside the cylinder; a vane that partitions a space formed between the cylinder and the piston into a suction chamber and a compression-discharge chamber; a suction port through which a working fluid is introduced into the suction chamber; and a discharge port through which the working fluid is discharged from the compression-discharge chamber, the compression mechanism being disposed inside the closed casing in such a manner as to be immersed in an oil held in the oil reservoir;

a convection suppressing portion dividing the oil reservoir into a plurality of sections in a vertical direction; and a communication path that allows the plurality of sections of the oil reservoir to communicate with each other.

In the rotary compressor, the communication path is located on the same side as the discharge port with respect to a reference plane, the reference plane being a plane including a central axis of the cylinder and passing through a contact line that is formed between an inner circumferential surface of the cylinder and an outer circumferential surface of the piston when the vane protrudes maximally toward the central axis of the cylinder.

Advantageous Effects of Invention

According to the above rotary compressor, the oil reservoir is divided by the convection suppressing portion into a plurality of sections in the vertical direction. The communication path allows the plurality of sections of the oil reservoir to communicate with each other. The communication path is located on the same side as the discharge port with respect to the reference plane. Therefore, the oil in the oil reservoir can be stagnated on the same side as the suction port with respect to the reference plane. Accordingly, the heat transfer coefficient on the wall surface of the compression mechanism is decreased on the same side as the suction port with respect to the reference plane, which can suppress transfer of heat from the oil to the drawn refrigerant through the wall surface of the compression mechanism. Consequently, the volumetric efficiency of the rotary compressor is enhanced.

DESCRIPTION OF EMBODIMENTS

Figure 1:
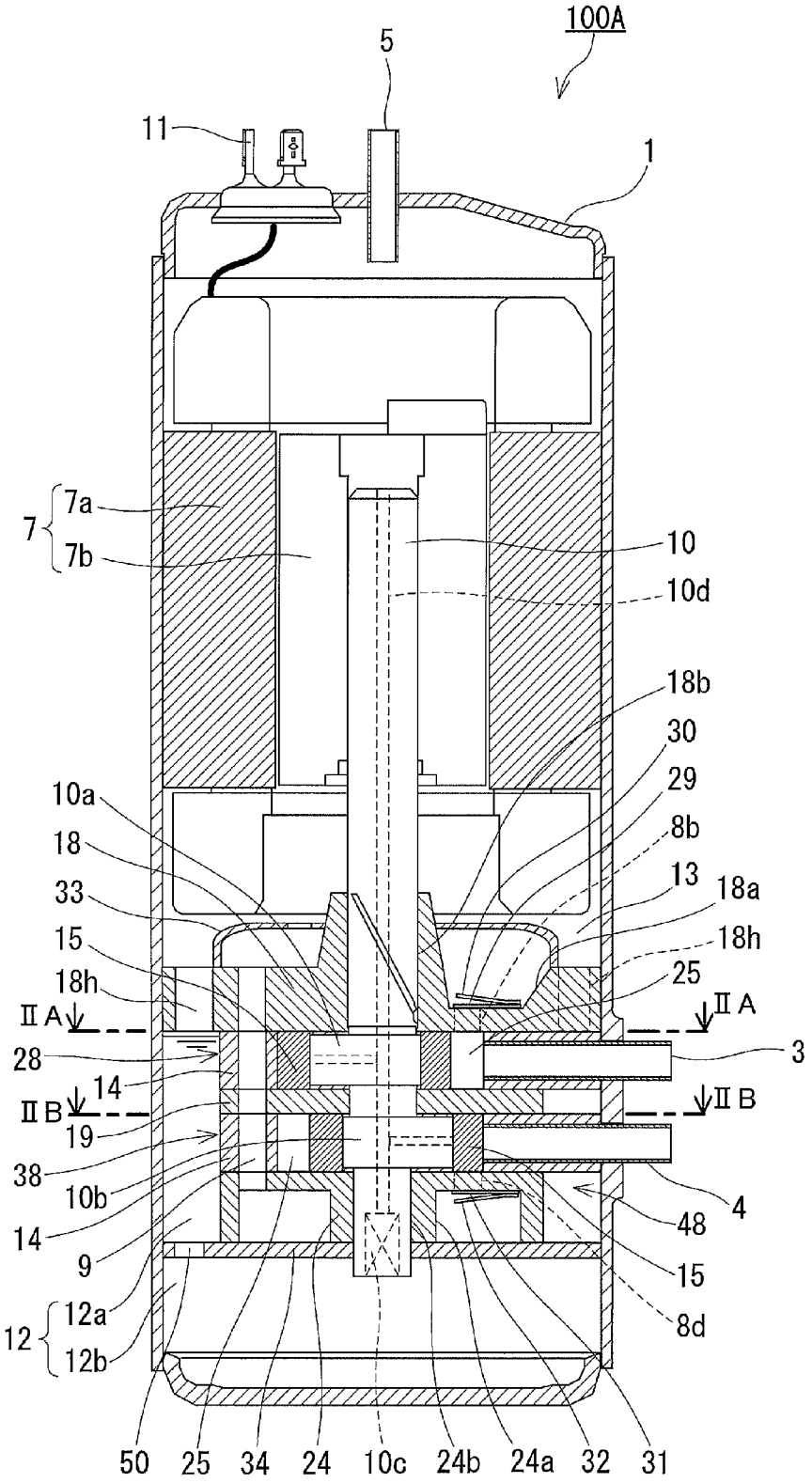
FIG. 1 is a longitudinal cross-sectional view of a rotary compressor according to an embodiment of the present invention.

A first aspect of the present disclosure provides a rotary compressor including:

a closed casing including an oil reservoir;

a compression mechanism including: a cylinder; a piston disposed inside the cylinder; a vane that partitions a space formed between the cylinder and the piston into a suction chamber and a compression-discharge chamber; a suction port through which a working fluid is introduced into the suction chamber; and a discharge port through which the working fluid is discharged from the compression-discharge chamber, the compression mechanism being disposed inside the closed casing in such a manner as to be immersed in an oil held in the oil reservoir;

a convection suppressing portion dividing the oil reservoir into a plurality of sections in a vertical direction; and a communication path that allows the plurality of sections of the oil reservoir to communicate with each other.

In the rotary compressor, the communication path is located on the same side as the discharge port with respect to a reference plane, the reference plane being a plane including a central axis of the cylinder and passing through a contact line that is formed between an inner circumferential surface of the cylinder and an outer circumferential surface of the piston when the vane protrudes maximally toward the central axis of the cylinder.

A second aspect provides the rotary compressor as set forth in the first aspect, wherein the communication path is a communication hole formed in the convection suppressing portion. Formation of the communication hole in the convection suppressing portion is easy, and is desirable from a design standpoint.

A third aspect provides the rotary compressor as set forth in the second aspect, wherein the convection suppressing portion has two holes as the communication hole. With such a configuration, there is the potential for further reduction in the flow of the oil on the same side as the suction port with respect to the reference plane.

A fourth aspect provides the rotary compressor as set forth in any one of the first to third aspects, wherein the convection suppressing portion includes a plate-shaped member. With such a configuration, the above-described effects can be obtained at low cost without significant design change.

A fifth aspect provides the rotary compressor as set forth in any one of the first to fourth aspects, wherein the convection suppressing portion is formed integrally with a component of the compression mechanism. With such a configuration, the above-described effects can be obtained at low cost without significant design change.

A sixth aspect provides the rotary compressor as set forth in any one of the first to fifth aspects, further including: a second convection suppressing portion disposed closer to a surface of the oil than the convection suppressing portion and dividing a selected one of the plurality of sections of the oil reservoir further into a plurality of sections in the vertical direction; and a second communication path that allows the plurality of sections separated by the second convection suppressing portion to communicate with each other, wherein the second communication path is located on the same side as the discharge port with respect to the reference plane. With such a configuration, the flow of the oil is further reduced on the same side as the suction port with respect to the reference plane.

Hereinafter, an embodiment of the present invention will be described with reference to the drawings. The present invention is not limited by the embodiment given below.

As shown in FIG. 1, a rotary compressor 100A of the present embodiment is a hermetic compressor, and includes a closed casing 1, a motor 7, a compression mechanism 48, and a shaft 10. The compression mechanism 48 has an upper muffler 33, an upper sealing member 18 (upper bearing member), a first compression block 28, an intermediate plate 19, a second compression block 38, a lower sealing member 24 (lower bearing member), and a lower end-face plate 34. The compression blocks 28 and 38 are sandwiched between the upper sealing member 18 (upper bearing member) and the lower sealing member 24 (lower bearing member). The intermediate plate 19 is disposed between the first compression block 28 and the second compression block 38. The motor 7 is disposed above the upper sealing member 18 in the closed casing 1. The shaft 10 extends in a vertical direction. The compression mechanism 48 is coupled to the motor 7 by the shaft 10. A terminal 11 for supplying electric power to the motor 7 is provided on the top of the closed casing 1.

The closed casing 1 has an internal space 13 to be filled with a refrigerant (working fluid) compressed by the compression mechanism 48. An oil reservoir 12 is formed at the bottom of the closed casing 1. A suction pipe 3, a suction pipe 4, and a discharge pipe 5 are connected to the closed casing 1. The suction pipe 3 penetrates through a trunk portion of the closed casing 1, and connects an accumulator (omitted from the drawings) to the first compression block 28. The suction pipe 4 penetrates through the trunk portion of the closed casing 1, and connects the accumulator to the second compression block 38. The suction pipes 3 and 4 serve to introduce the refrigerant to be compressed from the accumulator to the compression blocks 28 and 38. The discharge pipe 5 penetrates through the top of the closed casing 1, and opens into the internal space 13 of the closed casing 1. The discharge pipe 5 serves to discharge the compressed refrigerant to the outside of the rotary compressor 100A.

The motor 7 is composed of a stator 7*a* and a rotor 7*b*. The stator 7*a* is secured to the inner circumferential surface of the closed casing 1. The rotor 7*b* is secured to the shaft 10, and rotates together with the shaft 10. An oil feed path 10*d* is formed in a central portion of the shaft 10. An oil feed mechanism 10*c* (oil pump) that pumps up an oil of the oil reservoir 12 and feeds the oil to the oil feed path 10*d* is provided in a lower end portion of the shaft 10.

The compression mechanism 48 is disposed inside the closed casing 1 in such a manner as to be immersed in the oil held in the oil reservoir 12. In the compression mechanism 48, the first compression block 28 and the second compression block 38 are arranged in a direction parallel to the rotation axis of the shaft 10. The first compression block 28 has a suction port 8*a* and a discharge port 8*b*, and is driven by the motor 7 to draw the refrigerant through the suction port 8*a*, compress the refrigerant, and then discharge the refrigerant thorough the discharge port 8*b*. The second compression block 38 has a suction port 8*c* and a discharge port 8*d*, and is driven by the motor 7 to draw the refrigerant through the suction port 8*c*, compress the refrigerant, and then discharge the refrigerant through the discharge port 8*d*. The internal space 13 of the closed casing 1 is filled with the refrigerant discharged from the compression blocks 28 and 38. In the present embodiment, the structure of the first compression block 28 is the same as the structure of the second compression block 38.

Figure 2A:
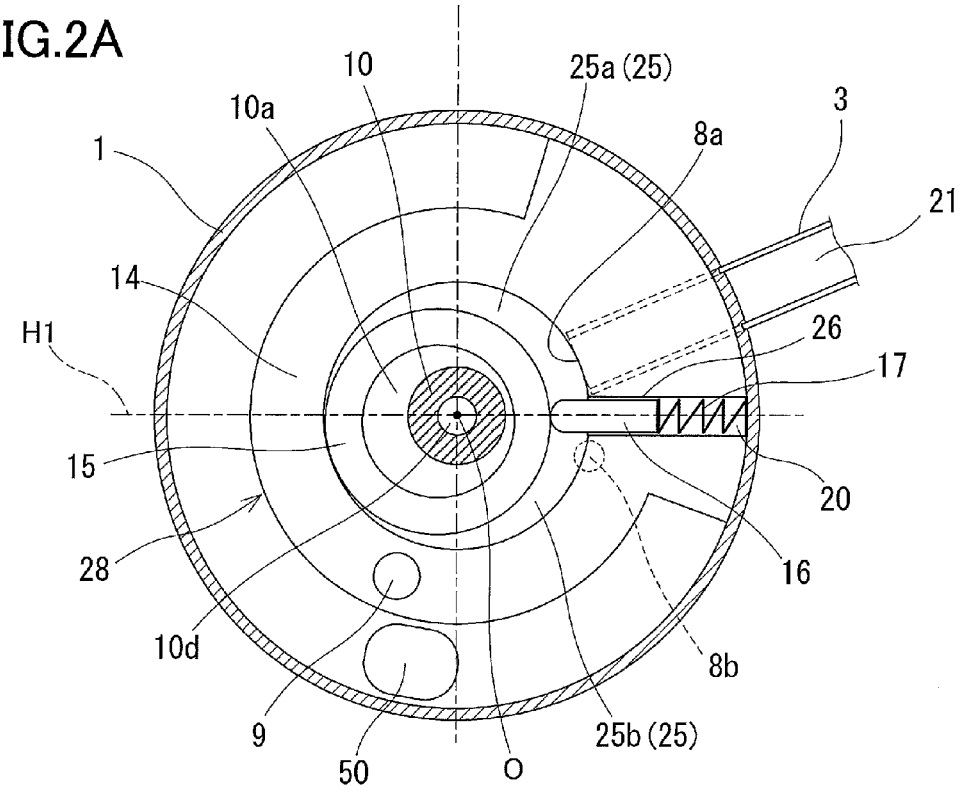
FIG. 2A is a transverse cross-sectional view of the rotary compressor of FIG. 1 taken along the IIA-IIA line.
Figure 2B:
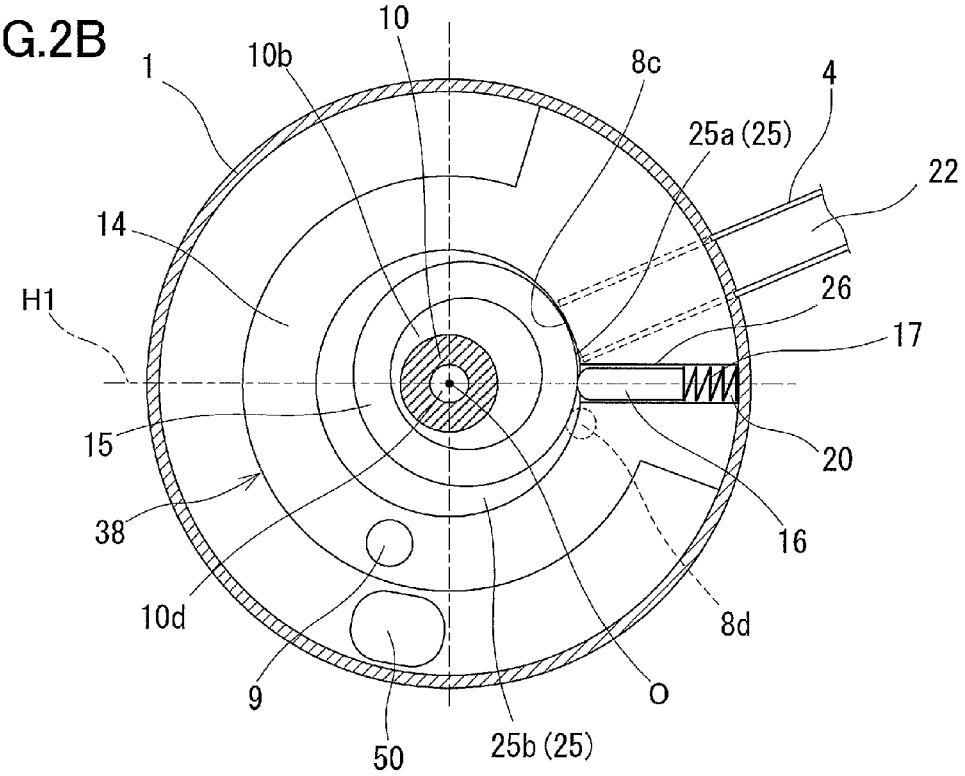
FIG. 2B is a transverse cross-sectional view of the rotary compressor of FIG. 1 taken along the IIB-IIB line.

As shown in FIG. 2A and FIG. 2B, the compression blocks 28 and 38 are each composed of a cylinder 14, a piston 15, a vane 16, and a spring 17. A first eccentric portion 10*a* and a second eccentric portion 10*b* are provided in the shaft 10. The direction of the eccentricity of the first eccentric portion 10*a* is 180 degrees away from the direction of the eccentricity of the second eccentric portion 10*b*. That is, the phase of the piston 15 of the first compression block 28 is shifted from the phase of the piston 15 of the second compression block 38 by 180 degrees in terms of the rotation angle of the shaft 10.

The piston 15 is disposed inside the cylinder 14, and is fitted to the first eccentric portion 10*a* or the second eccentric portion 10*b* of the shaft 10. A working chamber 25 is formed between the inner circumferential surface of the cylinder 14 and the outer circumferential surface of the piston 15. A vane groove 26 is formed in the cylinder 14. The vane 16 is disposed in the vane groove 26. A retention hole 20 opening at the outer end portion of the vane groove 26 toward both end faces of the cylinder 14 is formed at the rear of the vane groove 26. The spring 17 is disposed in the retention hole 20 and the vane groove 26 so as to push the vane 16 toward the piston 15. The tip of the vane 16 is in contact with the outer circumferential surface of the piston 15. The working chamber 25 is partitioned by the vane 16, and thus a suction chamber 25*a* and a compression-discharge chamber 25*b* are formed. The vane 16 may be integrated with the piston 15. That is, the piston 15 and the vane 16 may constitute a so-called swing piston.

In the first compression block 28, the suction port 8*a* is formed in the cylinder 14. The downstream end of the suction pipe 3 is connected to the suction port 8*a*. A suction path 21 through which the refrigerant is introduced into the working chamber 25 from the outside of the closed casing 1 is formed by the suction port 8*a* and the suction pipe 3. Similarly, in the second compression block 38, the suction port 8*c* is formed in the cylinder 14. The downstream end of the suction pipe 4 is connected to the suction port 8*c*. A suction path 22 through which the refrigerant is introduced into the working chamber 25 from the outside of the closed casing 1 is formed by the suction port 8*c* and the suction pipe 4. The suction paths 21 and 22 are also arranged in the direction parallel to the rotation axis of the shaft 10.

The vane 16 of the second compression block 38 is disposed at a position (angular position) coinciding with the position of the vane 16 of the first compression block 28 in the circumferential direction of the shaft 10. Therefore, there is a time difference corresponding to 180 degrees between when the piston 15 of the second compression block 38 is at a top dead center position (where the vane 16 is retracted maximally) and when the piston 15 of the first compression block 28 is at a top dead center position.

The upper sealing member 18 and the intermediate plate 19 seal both sides of the working chamber 25 of the first compression block 28 in the vertical direction. The intermediate plate 19 and the lower sealing member 24 seal both sides of the working chamber 25 of the second compression block 38 in the vertical direction. The upper sealing member 18 and the lower sealing member 24 function also as bearings by which the shaft 10 is rotatably supported.

The outer circumferential portion of the upper sealing member 18 is secured to the inner circumferential surface of the closed casing 1. By contrast, the intermediate plate 19 and the lower sealing member 24 have a diameter small enough not to seal the vane groove 26 completely. Therefore, the rearward end of the vane 16 is exposed to the oil reservoir 12 through the outer end portion of the vane groove 26.

In the present embodiment, the discharge ports 8*b* and 8*d* are formed in the upper sealing member 18 and the lower sealing member 24, respectively. That is, with respect to the first compression block 28, the upper sealing member 18 corresponds to a first sealing member, and the intermediate plate 19 corresponds to a second sealing member. With respect to the second compression block 38, the lower sealing member 24 corresponds to the first sealing member, and the intermediate plate 19 corresponds to the second sealing member.

As shown in FIG. 1, a recess 18*a* is formed in the upper surface of the upper sealing member 18. The recess 18*a* is located in the vicinity of the vane 16 of the first compression block 28. The discharge port 8*b* extends from the lower surface of the upper sealing member 18 to the bottom surface of the recess 18*a*. A discharge valve 29 and a stopper 30 are disposed in the recess 18*a*. The discharge valve 29 elastically deforms to open and close the discharge port 8*b*. The stopper 30 regulates the amount of deformation of the discharge valve 29. The upper muffler 33 is disposed above the upper sealing member 18. The upper muffler 33 covers the discharge port 8*b* as well as the space above the upper sealing member 18. The discharge port 8*b* communicates with the internal space 13 of the closed casing 1 via the space covered by the upper muffler 33. During the operation of the rotary compressor 100A, the surface of the oil in the oil reservoir 12 is located generally in the vicinity of the level of the lower surface of the upper sealing member 18.

A recess 24*a* is formed in the lower surface of the lower sealing member 24. The recess 24*a* is located in the vicinity of the vane 16 of the second compression block 38. The discharge port 8*d* extends from the upper surface of the lower sealing member 24 to the bottom surface of the recess 24*a*. A discharge valve 31 and a stopper 32 are disposed in the recess 24*a*. The discharge valve 31 elastically deforms to open and close the discharge port 8*d*. The stopper 32 regulates the amount of deformation of the discharge valve 31. The lower end-face plate 34 is disposed below the lower sealing member 24. The lower end-face plate 34 seals the space communicating with the discharge port 8*d* and formed in the lower sealing member 24 including the recess 24*a*. The space formed by the lower end-face plate 34 and the lower sealing member 24 communicates with the space covered by the upper muffler 33 through a communication path 9 extending from the lower sealing member 24 to the upper surface of the upper sealing member 18. That is, the discharge port 8*d* communicates with the internal space 13 of the closed casing 1 via the space covered by the lower end-face plate 34, the communication path 9, and the space covered by the upper muffler 33.

The lower end-face plate 34 extends in a direction (a radial direction of the shaft 10) perpendicular to the rotation axis of the shaft 10. In the radial direction of the shaft 10, the outer circumferential surface of the lower end-face plate 34 is located farther from the rotation axis of the shaft 10 than the outer circumferential surface of the cylinder 14, and is, for example, in contact with the inner circumferential surface of the closed casing 1. The lower end-face plate 34 has, for example, a circular shape in plan view. The lower end-face plate 34 is provided on the exterior of the compression mechanism 48 so as to divide the oil reservoir 12 into a plurality of sections in the vertical direction, and serves as a convection suppressing portion that suppresses convection of the oil in the oil reservoir 12. Specifically, a part of the lower end-face plate 34 serves as the convection suppressing portion. An upper oil reservoir 12*a* is formed above the lower end-face plate 34, and a lower oil reservoir 12*b* is formed below the lower end-face plate 34. The upper oil reservoir 12*a* is formed around the first compression block 28, the intermediate plate 19, the second compression block 38, and the lower sealing member 24. The lower oil reservoir 12*b* is located below the compression blocks 28 and 38 (compression mechanism 48).

The lower end portion of the shaft 10 penetrates through the central portion of the lower end-face plate 34, and is exposed to the lower oil reservoir 12*b*. The inlet port of the oil feed mechanism 10*c* opens into the lower oil reservoir 12*b*. The oil feed mechanism 10*c* draws in the oil from the lower oil reservoir 12*b*.

A communication hole 50 is formed in the lower end-face plate 34. In the radial direction of the shaft 10, the communication hole 50 is located between the inner circumferential surface of the closed casing 1 and the outer circumferential surface of the cylinder 14. The upper oil reservoir 12*a* communicates with the lower oil reservoir 12*b* via the communication hole 50. As shown in FIG. 2A and FIG. 2B, a plane is defined as a reference plane H1, the plane including a central axis O of the cylinder 14 and passing through a contact line that is formed between the inner circumferential surface of the cylinder 14 and the outer circumferential surface of the piston 15 when the vane 16 of the compression block 28 (or 38) protrudes maximally toward the central axis O of the cylinder 14. In this case, the communication hole 50 is located on the same side as the discharge port 8*b* (or 8*d*) with respect to the reference plane H1. The central axis O of the cylinder 14 coincides with the rotation axis of the shaft 10.

Hereinafter, in the present specification, the same side as the suction port 8*a* (or 8*c*) with respect to the reference plane H1 is referred to as a "suction side", and the same side as the discharge port 8*b* (or 8*d*) with respect to the reference plane H1 is referred to as a "discharge side". For the upper oil reservoir 12*a*, its portion located on the suction side is referred to as a "suction-side portion", and its portion located on the discharge side is referred to as a "discharge-side portion".

Figure 3:
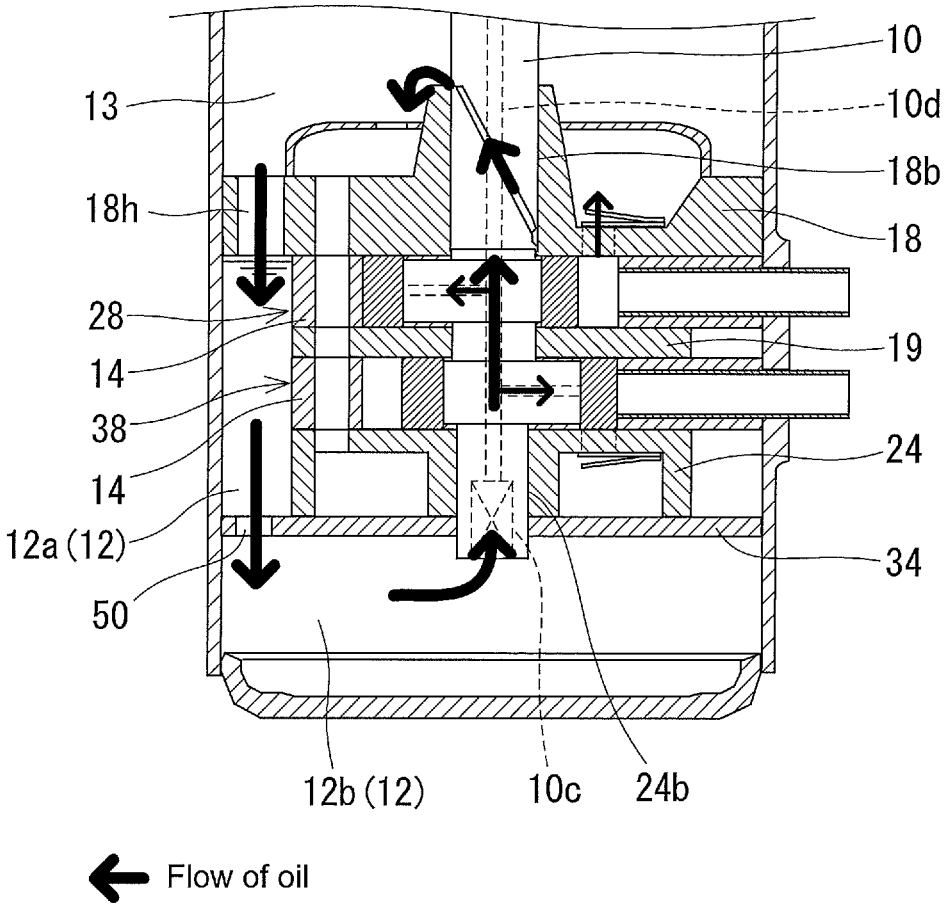
FIG. 3 is a diagram illustrating a flow of an oil in a compression mechanism and an oil reservoir.

As shown in FIG. 3, when an electric current is applied to the motor 7, the shaft 10 rotates so that the refrigerant is compressed in the compression mechanism 48. The lower end portion of the shaft 10 is in contact with the oil reservoir 12. Therefore, when the shaft 10 rotates, swirling flow occurs in the oil reservoir 12. In addition, when the shaft 10 rotates, the oil of the oil reservoir 12 is fed to the oil feed path 10*d* by the oil feed mechanism 10*c*. The oil is transported upward through the oil feed path 10*d*, and is fed to the first compression block 28 and the second compression block 38 through transverse holes provided in the first eccentric portion 10*a* and the second eccentric portion 10*b*.

The oil fed to the first compression block 28 lubricates the first compression block 28, then flows into a bearing portion 18*b* of the upper sealing member 18, and flows out of the upper end of the bearing portion 18*b* to the internal space 13 located below the rotor 7*b*. Thereafter, the oil passes through a communication hole 18*h* formed in the upper sealing member 18, and returns to the oil reservoir 12. The oil fed to the second compression block 38 lubricates the second compression block 38, then flows into a bearing portion 24*b* of the lower sealing member 24, and returns to the oil reservoir 12 through the lower end of the bearing portion 24*b*. During the process in which the oil is fed to the compression block 28 (or 38) and returns to the oil reservoir 12, the oil receives heat from the high-temperature refrigerant in the compression block 28 (or 38) to become hot.

When the oil returns to the oil reservoir 12 through the communication hole 18*h* of the upper sealing member 18, the oil flows into the upper oil reservoir 12*a* first, then passes through the communication hole 50, and returns to the lower oil reservoir 12*b*. Therefore, the flow of the returning oil is fast in the vicinity of the communication hole 50, and is slow at a site distant from the communication hole 50. That is, a fast flow of the returning oil having a high temperature is generated on the discharge side, while the flow of the oil is reduced on the suction side. In the case of a conventional rotary compressor (see Patent Literature 1) that does not have the lower end-face plate 34 serving as the convection suppressing portion, the flow velocity of the returning oil is generally uniform around the entire compression mechanism.

Furthermore, since the oil reservoir 12 is divided into the upper oil reservoir 12*a* and the lower oil reservoir 12*b* by the lower end-face plate 34, even when swirling flow of the oil is generated by the rotation of the shaft 10, the oil in the upper oil reservoir 12*a* is less likely to be affected by the swirling flow.

Therefore, the returning oil having a high temperature is less likely to pass through the suction-side portion of the upper oil reservoir 12*a*. The temperature of the oil in the upper oil reservoir 12*a* is relatively low on the suction side, and relatively high on the discharge side. Furthermore, in the suction-side portion of the upper oil reservoir 12*a*, the flow of the oil is reduced, and the flow velocity of the oil is decreased. On the suction side, therefore, the heat transfer coefficients on the outer circumferential surfaces of the cylinder 14 and the intermediate plate 19 are decreased. This accordingly suppresses transfer of heat via the cylinder 14 and the intermediate plate 19 to the low-temperature refrigerant having flowed into the suction chamber 25*a*. Consequently, the volumetric efficiency of the rotary compressor 100A is improved, and the performance of a refrigeration cycle apparatus using the rotary compressor 100A is enhanced.

The position and number of holes serving as the communication hole 18*h* in the upper sealing member 18 are not particularly limited. In general, a plurality of communication holes 18*h* are formed at regular angular intervals in the circumferential direction of the shaft 10 so that the oil can quickly return to the oil reservoir 12.

In the present embodiment, the lower end-face plate 34 is in contact with the closed casing 1. Specifically, the outer circumferential surface of the lower end-face plate 34 may be in contact with the closed casing 1 over the entire circumference, or a part of the outer circumferential surface of the lower end-face plate 34 may be in contact with the closed casing 1. However, it is not essential that the lower end-face plate 34 be in contact with the closed casing 1. A slight gap may be formed between the outer circumferential surface of the lower end-face plate 34 and the closed casing 1. In this case, it becomes easy to assemble the rotary compressor 100A. In addition, the slight gap can function as a passage for the refrigerant when the refrigerant dissolved in the oil forms into gas bubbles due to change in the operating conditions of the rotary compressor 100A. It is possible to avoid a situation where the gas refrigerant is accumulated in the lower oil reservoir 12*b* or the oil feed mechanism 10*c* draws in the gas refrigerant.

In the present embodiment, only one communication hole 50 is provided on the discharge side. The entire communication hole 50 is located on the discharged side. On the discharge side, however, a plurality of communication holes 50 may be formed in the lower end-face plate 34. In this case, there is the potential for further reduction in the flow of the oil in the suction-side portion of the upper oil reservoir 12*a*.

The means for allowing the upper oil reservoir 12*a* and the lower oil reservoir 12*b* to communicate with each other is not limited to the communication hole 50. For example, when a relatively large cut is formed in the outer circumferential portion of the lower end-face plate 34, such a cut can be used, instead of the communication hole 50, as a communication path that allows the upper oil reservoir 12*a* and the lower oil reservoir 12*b* to communicate with each other. However, formation of the communication hole 50 in the lower end-face plate 34 is easy, and is desirable from a design standpoint.

In the present embodiment, the lower end-face plate 34 serving as the convection suppressing portion is a plate-shaped member. The lower end-face plate 34 for covering the space below the lower sealing member 24 is used as the convection suppressing portion. Specifically, the outer circumferential portion of the lower end-face plate 34 serves as the convection suppressing portion. The lower end-face plate 34 is a component of the compression mechanism 48. That is, the convection suppressing portion is formed integrally with a component of the compression mechanism 48. With such a configuration, the above-described effects can be obtained at low cost without significant design change.

Hereinafter, several modifications will be described. For the modifications given below, the same components as those described with reference to FIG. 1 to FIG. 3 are denoted by the same reference characters, and descriptions thereof are omitted.

Modification 1

Figure 4:
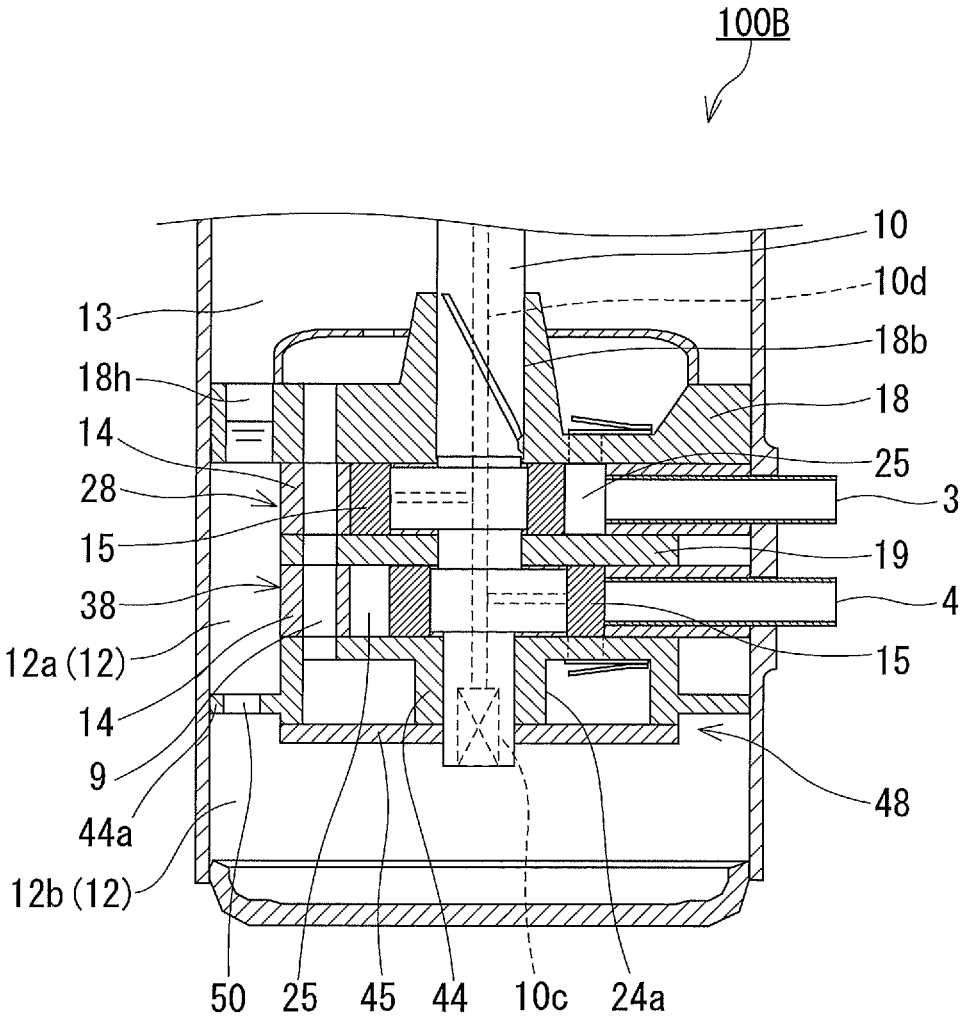
FIG. 4 is a partial longitudinal cross-sectional view of a rotary compressor according to a modification 1.

As shown in FIG. 4, a rotary compressor 100B according to a modification 1 includes a lower sealing member 44 serving as the convection suppressing portion. The lower sealing member 44 has a flange portion 44*a* extending outwardly in the radial direction of the shaft 10. The flange portion 44*a* has a ring shape in plan view. The recess 24*a* of the lower sealing member 44 is closed by a lower end-face plate 45. In the present modification, the lower end-face plate 45 has a size that is necessary and sufficient for closing the recess 24*a* of the lower sealing member 44. The outer diameter of the lower end-face plate 45 is, for example, equal to the outer diameter of the cylinder 14.

The communication hole 50 is formed in the flange portion 44*a* of the lower sealing member 44. The upper oil reservoir 12*a* communicates with the lower oil reservoir 12*b* through the communication hole 50. The outer circumferential surface of the flange portion 44*a* of the lower sealing member 44 may be in contact with the closed casing 1 over the entire circumference, or a part of the outer circumferential surface may be in contact with the closed casing 1. A slight gap may be formed between the outer circumferential surface of the flange portion 44*a* and the closed casing 1. This is as described in the above embodiment.

Modification 2

Figure 5:
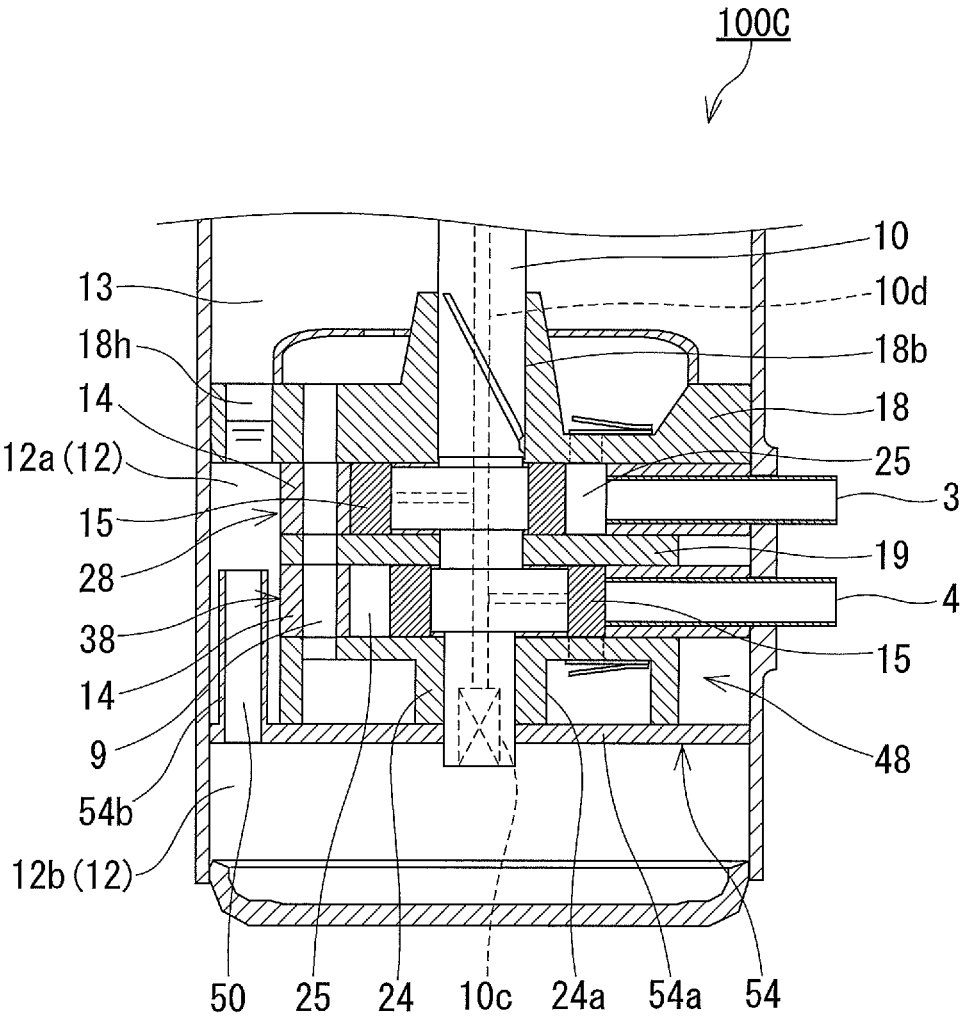
FIG. 5 is a partial longitudinal cross-sectional view of a rotary compressor according to a modification 2.

As shown in FIG. 5, a rotary compressor 100C according to a modification 2 includes a lower end-face plate 54 (convection suppressing portion) having a circular plate portion 54*a* and a nozzle portion 54*b*. The recess 24*a* of the lower sealing member 24 is closed by the circular plate portion 54*a*. The outer circumferential surface of the circular plate portion 54*a* is, for example, in contact with the inner circumferential surface of the closed casing 1. That is, the circular plate portion 54*a* has the same structure as the lower end-face plate 34 described with reference to FIG. 1 to FIG. 3. The nozzle portion 54*b* is provided in the outer circumferential portion of the circular plate portion 54*a*, and extends upwardly in the vertical direction. The upper open end of the nozzle portion 54*b* is located in the upper oil reservoir 12*a*. The communication hole 50 is formed inside the nozzle portion 54*b*.

According to the present modification, the returning oil flows into the upper oil reservoir 12*a* through the communication hole 18*h* of the upper sealing member 18, passes through the nozzle portion 54*b* (communication hole 50), and moves to the lower oil reservoir 12*b*. That is, in the present modification, the flow of the returning oil is further restricted compared to the case of the above embodiment. The convection of the oil in the suction-side portion of the upper oil reservoir 12*a* is further suppressed. According to the present modification, the effect of reducing heat reception by the drawn refrigerant is larger than that in the above embodiment. Consequently, the performance of a refrigeration cycle apparatus using the rotary compressor 100C is further enhanced.

Modification 3

Figure 6:
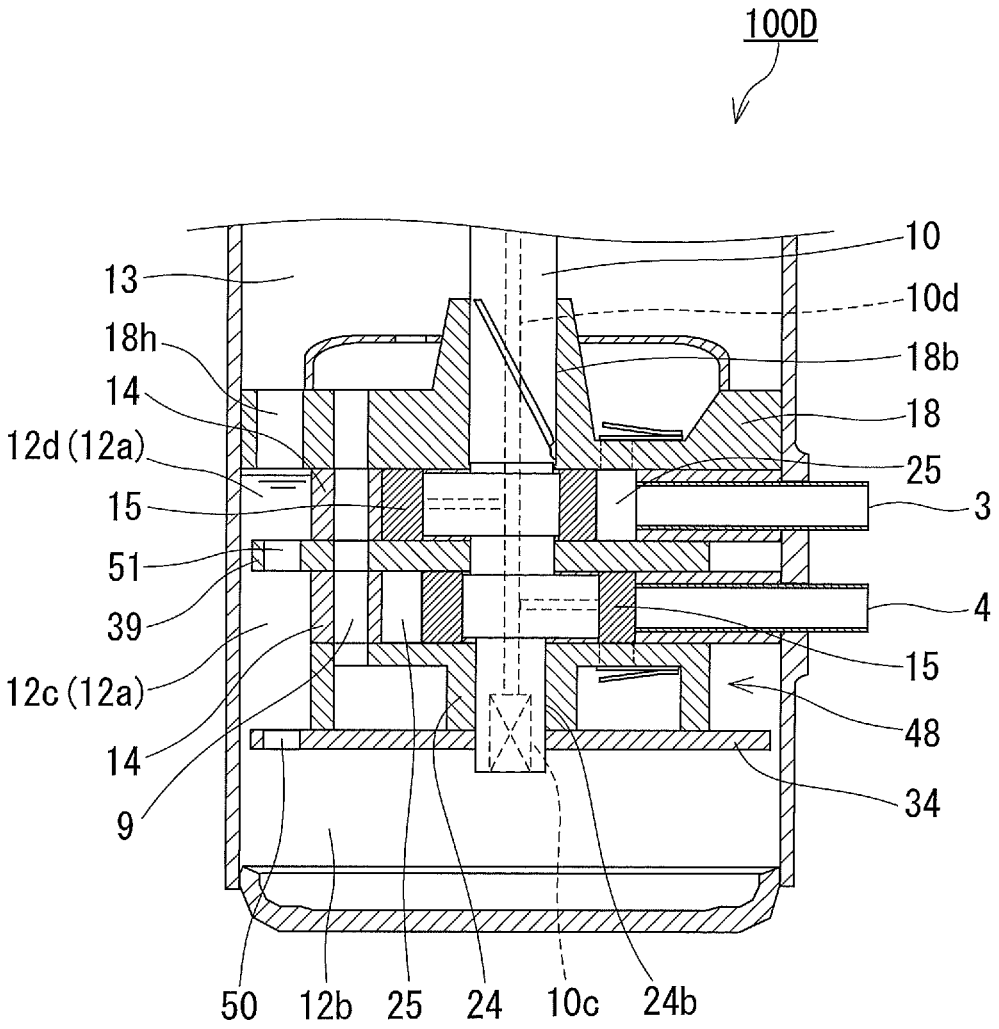
FIG. 6 is a partial longitudinal cross-sectional view of a rotary compressor according to a modification 3.

As shown in FIG. 6, a rotary compressor 100D according to a modification 3 includes an intermediate plate 39 serving as the convection suppressing portion. Except for the intermediate plate 39, the rotary compressor 100D has approximately the same structure as the rotary compressor 100A described above.

In the present modification, the intermediate plate 39 extends outwardly in the radial direction of the shaft 10. A narrow gap is formed between the outer circumferential surface of the intermediate plate 39 and the inner circumferential surface of the closed casing 1. The upper oil reservoir 12*a* is divided into an intermediate oil reservoir 12*c* and an uppermost oil reservoir 12*d* by the intermediate plate 39. That is, the intermediate plate 39 serves as a second convection suppressing portion disposed closer to the surface of the oil than the lower end-face plate 34 (first convection suppressing portion) so that a selected one of the plurality of sections 12*a* and 12*b* of the oil reservoir 12 is divided further into the plurality of sections 12*c* and 12*d* in the vertical direction.

A second communication hole 51 is formed in the outer circumferential portion of the intermediate plate 39. The uppermost oil reservoir 12*d* communicates with the intermediate oil reservoir 12*c* via the second communication hole 51. That is, the second communication hole 51 serves as a second communication path that allows the plurality of sections 12*c* and 12*d* separated by the intermediate plate 39 (second convection suppressing portion) to communicate with each other. The second communication hole 51 is also located on the discharge side. When the communication hole 50 and the second communication hole 51 are projected onto a plane perpendicular to the rotation axis of the shaft 10, the projection of the communication hole 50 overlaps the projection of the second communication hole 51. That is, the second communication hole 51 is formed at approximately the same position as the communication hole 50 in the circumferential direction of the shaft 10.

When the oil returns to the oil reservoir 12 through the communication hole 18*h* of the upper sealing member 18, the oil flows into the uppermost oil reservoir 12*d* first, then passes through the second communication hole 51, and flows into the intermediate oil reservoir 12*c*. Thereafter, the oil passes through the communication hole 50, and returns to the lower oil reservoir 12*b*. Therefore, the flow of the returning oil is fast in the vicinity of the communication holes 50 and 51, and is slow at a site distant from the communication holes 50 and 51. In the intermediate oil reservoir 12*c*, the oil flows principally along a straight line connecting the communication hole 50 to the second communication path 51 even when the returning oil having a high temperature flows into the uppermost oil reservoir 12*d* from all sides of the shaft 10 uniformly. Therefore, the flow of the oil is further reduced on the suction side compared to the case of the above embodiment.

Thus, the returning oil having a high temperature is less likely to pass through the suction-side portion of the uppermost oil reservoir 12*d*. The flow of the oil in the suction-side portion of the intermediate oil reservoir 12*c* is very slow. Therefore, the temperature of the suction-side portion of the intermediate oil reservoir 12*c* can be made lower than the temperature of the discharge-side portion of the upper oil reservoir 12*a* and the temperature of the lower oil reservoir 12*b*.

Furthermore, in the suction-side portion of the intermediate oil reservoir 12*c*, the flow of the oil is reduced, and the flow velocity of the oil is decreased. On the suction side, therefore, the heat transfer coefficients on the outer circumferential surface of the cylinder 14 and the surface of the intermediate plate 39 are decreased. This accordingly suppresses transfer of heat via the cylinder 14 and the intermediate plate 39 to the low-temperature refrigerant having flowed into the suction chamber 25*a*. Consequently, the volumetric efficiency of the rotary compressor 100D is improved, and the performance of a refrigeration cycle apparatus using the rotary compressor 100D is enhanced.

Modification 4

Figure 7:
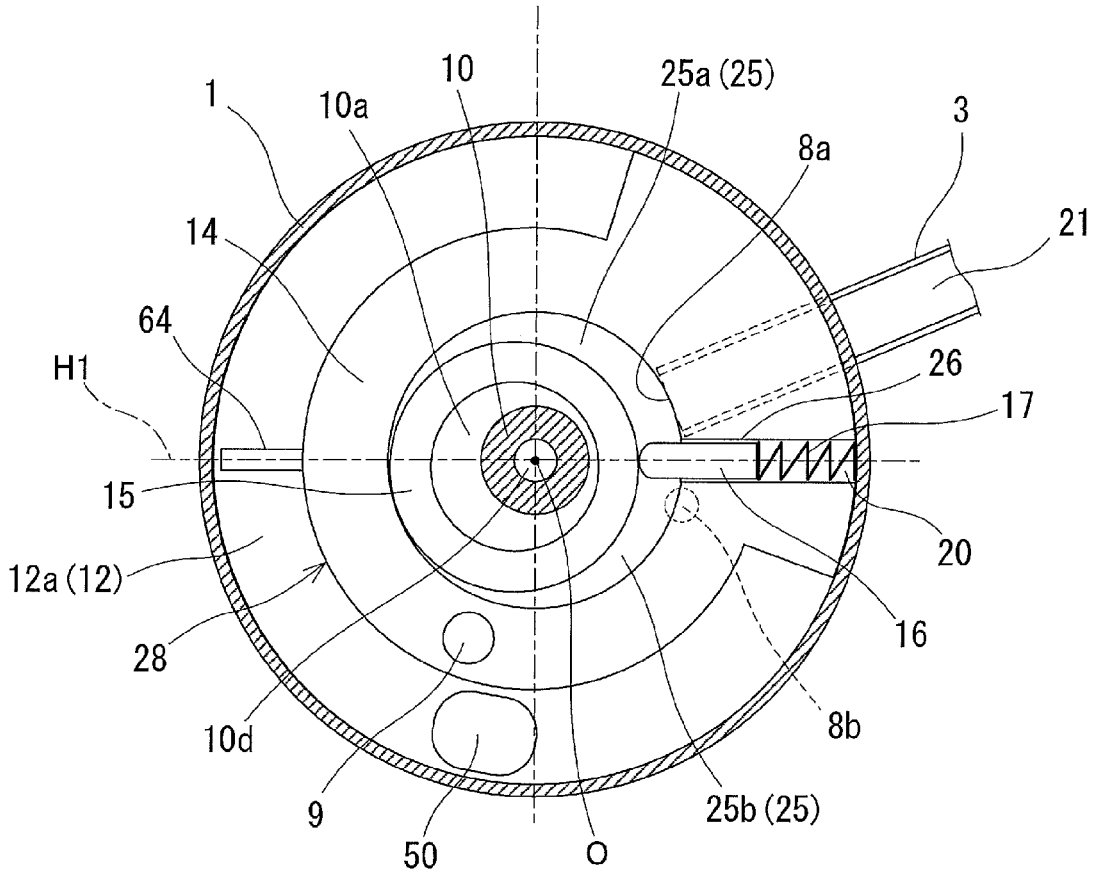
FIG. 7 is a transverse cross-sectional view of a rotary compressor according to a modification 4.

As shown in FIG. 7, a rotary compressor 100E according to a modification 4 includes the components of the rotary compressor 100A described above, and additionally includes a convection suppressing portion 64 (third convection suppressing portion) that suppresses convection of the oil in the oil reservoir 12. Except for the convection suppressing portion 64, the rotary compressor 100E has the same structure as the rotary compressor 100A.

The convection suppressing portion 64 is formed integrally with the cylinder 14 in such a manner as to protrude outwardly from the outer circumferential surface of the cylinder 14. The convection suppressing portion 64 divides the upper oil reservoir 12*a* in the circumferential direction of the shaft 10. The upper oil reservoir 12*a* is divided into a suction-side portion and a discharge-side portion by the convection suppressing portion 64. The convection suppressing portion 64 is provided, for example, at such a position that the convection suppressing portion 64 lies in the reference plane H1. In the radial direction of the shaft 10, the outer circumferential surface of the convection suppressing portion 64 may be in contact with the inner circumferential surface of the closed casing 1 or may be slightly away from the inner circumferential surface of the closed casing 1. With the convection suppressing portion 64, the flow of the oil in the suction-side portion of the upper oil reservoir 12*a* is further reduced.

Other Modifications

Each of the rotary compressors 100A to 100E described in the present specification is a two-piston rotary compressor including the compression blocks 28 and 38. However, the number of the compression blocks is not particularly limited. That is, the techniques disclosed in the present specification can be applied also to a one-piston rotary compressor, and can be applied also to a rotary compressor including three or more compression blocks.

INDUSTRIAL APPLICABILITY

The present invention is useful for compressors of refrigeration cycle apparatuses that can be used in electrical appliances such as hot water dispensers, hot-water heaters, and air conditioners.

The invention claimed is:

1. A rotary compressor comprising:

a closed casing comprising an oil reservoir;

a compression mechanism comprising: a cylinder; a piston disposed inside the cylinder; a vane that partitions a space formed between the cylinder and the piston into a suction chamber and a compression-discharge chamber; a suction port through which a working fluid is introduced into the suction chamber; and a discharge port through which the working fluid is discharged from the compression-discharge chamber, the compression mechanism being disposed inside the closed casing in such a manner as to be immersed in an oil held in the oil reservoir;

a convection suppressing portion dividing the oil reservoir into a plurality of sections in a vertical direction;

a communication path that allows the plurality of sections of the oil reservoir to communicate with each other;

a motor disposed in the closed casing; and a shaft coupling the motor and the compression mechanism, wherein the compression mechanism further comprises an upper bearing member located on an upper side of the cylinder and a lower bearing member located on a lower side of the cylinder, the convection suppressing portion is positioned lower than an upper face of the lower bearing member and protrudes radially outwardly beyond an outer circumferential surface of the cylinder, the communication path is located only on the same side as the discharge port with respect to a reference plane, the reference plane being a plane including a central axis of the cylinder and passing through a contact line that is formed between an inner circumferential surface of the cylinder and an outer circumferential surface of the piston when the vane protrudes maximally toward the central axis of the cylinder, the plurality of sections of the oil reservoir include an upper oil reservoir and a lower oil reservoir, the upper oil reservoir is formed between the outer circumferential surface of the cylinder and an inner circumferential surface of the closed casing, and the upper oil reservoir is present directly above the communication path and the lower oil reservoir is present directly under the communication path in the vertical direction.

2. The rotary compressor according to claim 1, wherein the communication path is a communication hole formed in the convection suppressing portion.

3. The rotary compressor according to claim 2, wherein the convection suppressing portion has two or more holes as the communication hole.

4. The rotary compressor according to claim 1, wherein the convection suppressing portion comprises a plate-shaped member.

5. The rotary compressor according to claim 1, further comprising:

a second convection suppressing portion disposed closer to a surface of the oil than the convection suppressing portion and dividing a selected one of the plurality of sections of the oil reservoir further into a plurality of sections in the vertical direction; and a second communication path that allows the plurality of sections separated by the second convection suppressing portion to communicate with each other, wherein the second communication path is located on the same side as the discharge port with respect to the reference plane.

6. The rotary compressor according to claim 1, wherein the upper bearing member and the lower bearing member rotatably support the shaft, the convection suppressing portion is formed by a part of the lower bearing member, and the motor, the compression mechanism, and the lower bearing member are arranged in this order in a direction parallel to a rotation axis of the shaft.

7. The rotary compressor according to claim 1, wherein the compression mechanism further comprises a lower end-face plate disposed below the lower bearing member, the lower end-face plate seals a space formed by the lower sealing member, the discharge port communicates with the space sealed by the lower end-face plate, and the convection suppressing portion is formed by a part of the lower end-face plate.

8. The rotary compressor according to claim 7, wherein the motor, the compression mechanism, the lower bearing member, and the lower end-face plate are arranged in this order in a direction parallel to a rotation axis of the shaft.

9. The rotary compressor according to claim 1, wherein the convection suppressing portion comprises a plate-shaped member with an upper surface and a lower surface, and both the upper surface and the lower surface are in contact with the oil held in the oil reservoir.

10. A rotary compressor comprising:

a closed casing comprising an oil reservoir;

a compression mechanism disposed inside the closed casing in such a manner as to be immersed in an oil held in the oil reservoir, a motor disposed in the closed casing;

a shaft coupling the motor and the compression mechanism;

a convection suppressing portion dividing the oil reservoir into a plurality of sections in a vertical direction; and a communication path that allows the plurality of sections of the oil reservoir to communicate with each other, wherein the compression mechanism comprises an upper bearing member, a first compression block, an intermediate plate, a second compression block, and a lower bearing member, the upper bearing member is located on an upper side of the first compression block, the lower bearing member is located on a lower side of the second compression block, the motor, the first compression block, and the second compression block are arranged in this order in a direction parallel to a rotation axis of the shaft, the first compression block comprises: a first cylinder; a first piston disposed inside the first cylinder; a first vane that partitions a space formed between the first cylinder and the first piston into a first suction chamber and a first compression-discharge chamber; a first suction port through which a working fluid is introduced into the first suction chamber; and a first discharge port through which the working fluid is discharged from the first compression-discharge chamber, the second compression block comprises: a second cylinder; a second piston disposed inside the second cylinder; a second vane that partitions a space formed between the second cylinder and the second piston into a second suction chamber and a second compression-discharge chamber; a second suction port through which the working fluid is introduced into the second suction chamber; and a second discharge port through which the working fluid is discharged from the second compression-discharge chamber, a phase of the first piston of the first compression block is shifted from a phase of the second piston of the second compression block by 180 degrees in terms of the rotation angle of the shaft, the communication path is located on the same side as the first discharge port with respect to a reference plane, the reference plane being a plane including a central axis of the first cylinder and passing through a contact line that is formed between an inner circumferential surface of the first cylinder and an outer circumferential surface of the first piston when the first vane protrudes maximally toward the central axis of the first cylinder, the intermediate plate is disposed between the first compression block and the second compression block, the convection suppressing portion is formed by a part of the intermediate plate, and the part of the intermediate plate protrudes radially outwardly beyond outer circumferential surfaces of the first cylinder and the second cylinder, and includes an upper surface and a lower surface each being in contact with the oil.

* * * * *